US006295857B1

(12) United States Patent
Rupoli

(10) Patent No.: US 6,295,857 B1
(45) Date of Patent: Oct. 2, 2001

(54) METHOD AND MACHINE FOR AUTOMATICALLY BENDING PROFILED ELEMENTS AND THE LIKE

(75) Inventor: Simone Rupoli, Fano (IT)

(73) Assignee: Schnell S.p.A., Fano (IT)

( * ) Notice: Subject to any disclaimer, the term of this patent is extended or adjusted under 35 U.S.C. 154(b) by 0 days.

(21) Appl. No.: 09/044,800

(22) Filed: Mar. 20, 1998

(30) Foreign Application Priority Data

Mar. 20, 1997 (IT) ..... MO97A0045

(51) Int. Cl.[7] ..... B21D 11/12; B21D 7/024
(52) U.S. Cl. ..... 72/307; 72/306; 72/294
(58) Field of Search ..... 72/306, 307, 388, 72/217, 219, 149, 294

(56) References Cited

U.S. PATENT DOCUMENTS 4,561,279 * 12/1985 Wears ..... 72/217
4,563,802 * 1/1986 Benteler ..... 72/307
4,766,756 * 8/1988 Shiue ..... 72/306
5,113,683 * 5/1992 Lafrasse ..... 72/306
5,182,932 * 2/1993 Ritter ..... 72/306
5,197,320 * 3/1993 Saegusa ..... 72/307
5,228,322 * 7/1993 Del Fabro ..... 72/307

FOREIGN PATENT DOCUMENTS

3644482 * 7/1988 (DE) ..... 72/307
0 538 595 4/1993 (EP) .
93 19865 10/1993 (WO) .

* cited by examiner

*Primary Examiner*—Daniel C. Crane
(74) *Attorney, Agent, or Firm*—Guido Modiano; Albert Josif; Daniel O'Byrne

(57) ABSTRACT

The machine for automatically bending profiled elements and the like comprises a line for feeding the profiled elements to be bent. Bending means are suitable to end at least a rear end of the profiled elements in a bending station which is arranged in an upper or lower position with respect to the feed line of the profiled elements. Transfer means are suitable to move the profiled elements from the feed line to the lower or upper bending station. Drawing means act at the bending station to move the profiled elements longitudinally.

15 Claims, 13 Drawing Sheets

METHOD AND MACHINE FOR AUTOMATICALLY BENDING PROFILED ELEMENTS AND THE LIKE

BACKGROUND OF THE INVENTION

The present invention relates to a method for automatically bending the ends of profiled elements and the like, particularly rods for reinforced concrete, and to a machine for performing the method.

It is known that shaped rods, used for example to produce reinforced-concrete frames, are generally produced by means of devices which subject the rod, in coils or cut into bars, to an adapted plurality of bendings. These forming machines usually have at least one bending unit provided with a bending head which has a central pivot, an abutment and an eccentric bending pivot.

More particularly, bending machines are currently known which allow to produce, directly from coils of rod, a large number of different products, such as open or closed stirrups, circular or polygonal spirals, straight bars and the like. These machines conveniently have a plurality of elements for straightening and feeding the rod, a unit for cutting the rods to be bent and one or more bending units of the above-mentioned type arranged in series.

A specific problem that occurs in the field being considered is the need to provide rods which are bent at their opposite ends according to preset profiles. Bending both ends of the rods is in fact generally complicated and requires a relatively long time which causes limited productivity.

For this purpose, forming machines are known which have two bending heads that allow to separately bend the opposite ends of the rods. Said forming machines have a complicated structure and do not allow to form stirrups except with severe limitations.

It is also known to use machines meant to form stirrups, commonly known as stirrup benders, provided with auxiliary units which allow them to act as forming machines. These machines, however, have a very long operating time for producing rods bent at their ends and therefore cannot achieve high productivity.

SUMMARY OF THE INVENTION

The aim of the present invention is to solve the cited problem, by providing a method which allows to simply and quickly perform the automatic bending of the opposite ends of profiled elements and the like along any preset profile.

Within the scope of this aim, an object of the present invention is to provide a machine which performs said automatic bending of profiled elements and the like, has a simple and functional structure, is safely reliable in operation, highly flexible in use and capable of ensuring high productivity.

This aim and this object are both achieved, according to the invention, by the present machine for automatically bending profiled elements and the like, characterized in that it comprises a line for feeding the profiled elements to be bent; bending means which are suitable to bend at least a rear end of said profiled elements in a bending station which is arranged in a upper or lower position with respect to said feed line and lies substantially on a worktable which contains said line for feeding said profiled elements; means for transferring said profiled elements from said feed line to said bending station arranged in said lower or upper position.

BRIEF DESCRIPTION OF THE DRAWINGS

The details of the invention will become apparent from the detailed description of a preferred embodiment of the machine for automatically bending profiled elements, illustrated only by way of non-limitative example in the accompanying drawings, wherein.

DESCRIPTION OF THE PREFERRED EMBODIMENTS

Figure 1:
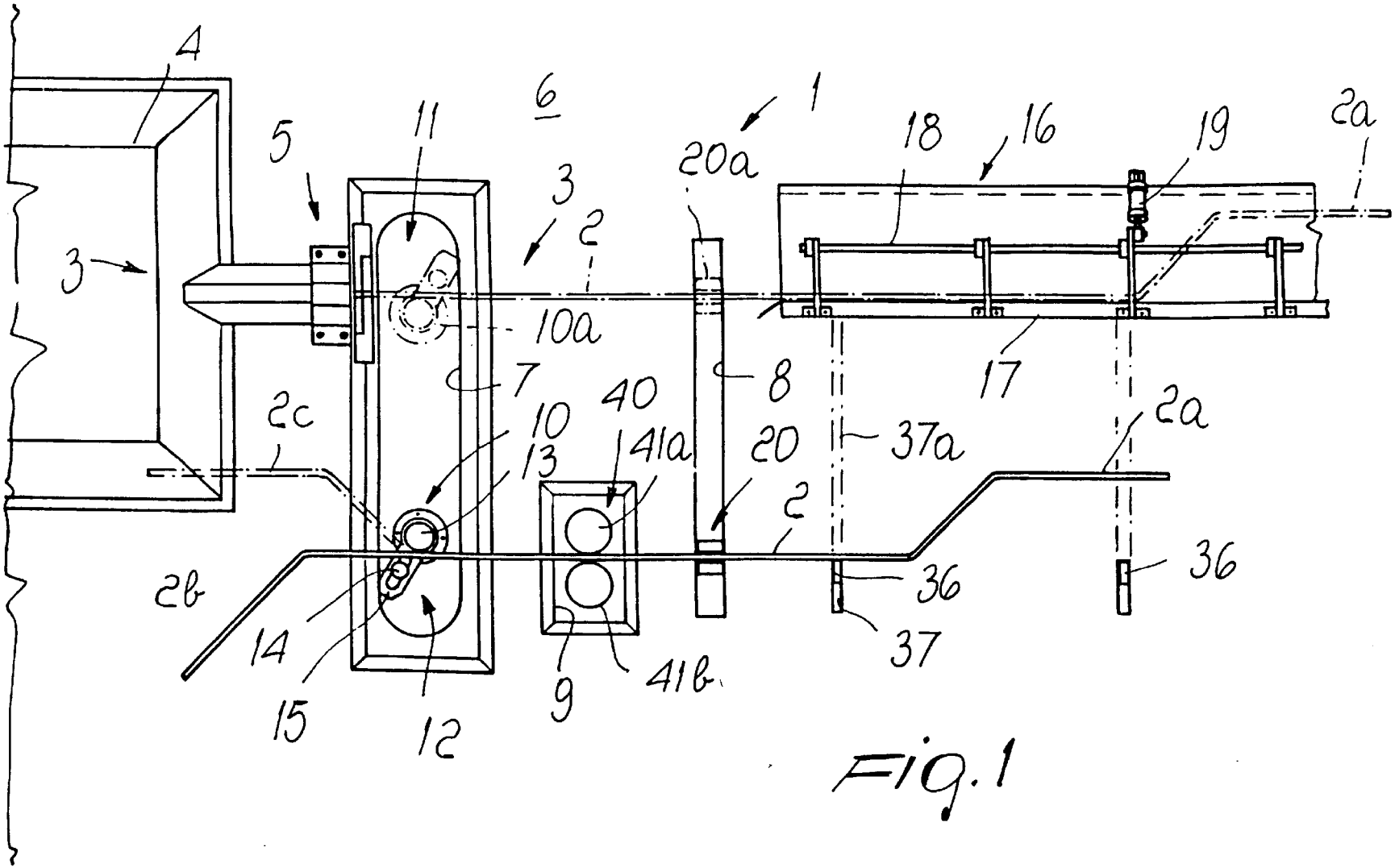
FIG. 1 is a schematic side view of a first embodiment of the machine for automatically bending profiled elements according to the invention.

With particular reference to the above figures, the reference numeral 1 generally designates the machine for automatically bending profiled elements 2, for example rods for reinforced concrete and the like, hereinafter referenced to as rods for the sake of simplicity.

The machine 1 has a line 3 for feeding the rods 2 to be bent. If the rods originate from coils, the machine has, in an initial region which is not shown, conventional units for feeding the rods 2 to be bent, the housing 4 whereof is partially visible; at the outlet of said feeder units, along the feed line 3, a cutting unit 5 is provided which is also of a known type.

The bending machine is provided with bending means suitable to bend a front end 2*a* and a rear end 2*b* of the rods 2.

In a first embodiment, shown in FIG. 1, said bending means are constituted by a bending unit 10 which moves between a first bending position 11, at said feed line, and a second bending position 12, which is lower than said upper position for feeding the rods 2.

The bending unit 10 is substantially constituted, in a per se known manner, by a cylindrical head which can be made to rotate and is provided with a central pivot 13 and with a bending pivot 14 which is supported eccentrically, in an adjustable position, by a radial arm 15 of said head.

The bending unit 10 operates at a worktable formed by a front platform 6 which usually is or can be tilted with respect to the vertical; said platform 6 has an opening 7 from which said head of the bending unit 10 protrudes. The opening 7 is preferably provided at a recessed region of the platform 6 which has suitably inclined sides; the operating elements that protrude from the platform 6 are further covered, in the active configuration, by a suitable cover applied to said platform.

Figure 4:
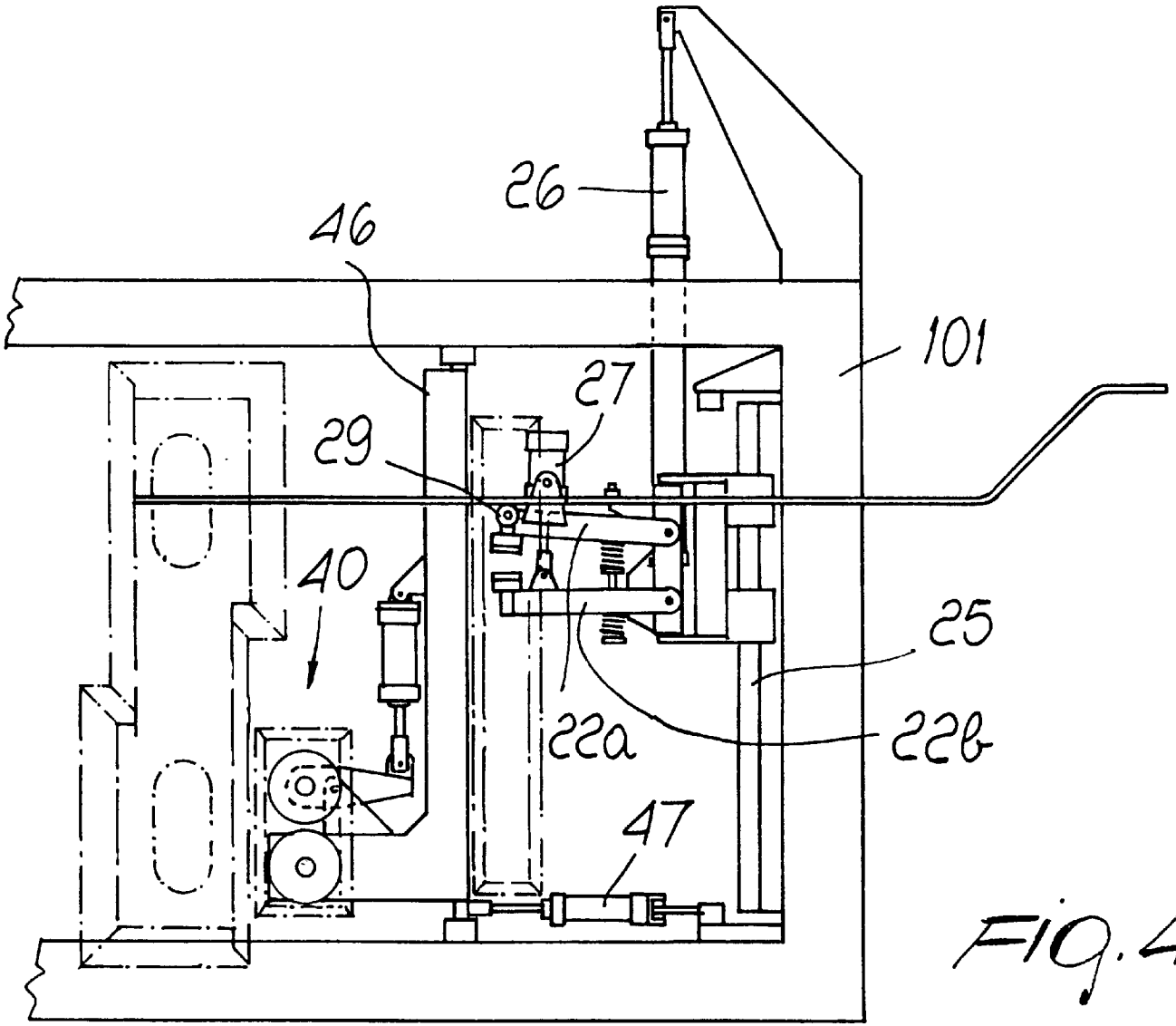
FIG. 4 is a detail side view of the bending machine according to the invention, illustrating said means for drawing and transferring the profiled elements.

Means for transferring the rods 2 from the upper bending position 11 to the lower bending position 12 work to the side of the bending unit 10 and are generally designated by the reference numeral 20. The transfer means 20 work at a second opening 8 which is formed in the front platform 6 (see also FIGS. 4 and 5).

Figure 6:
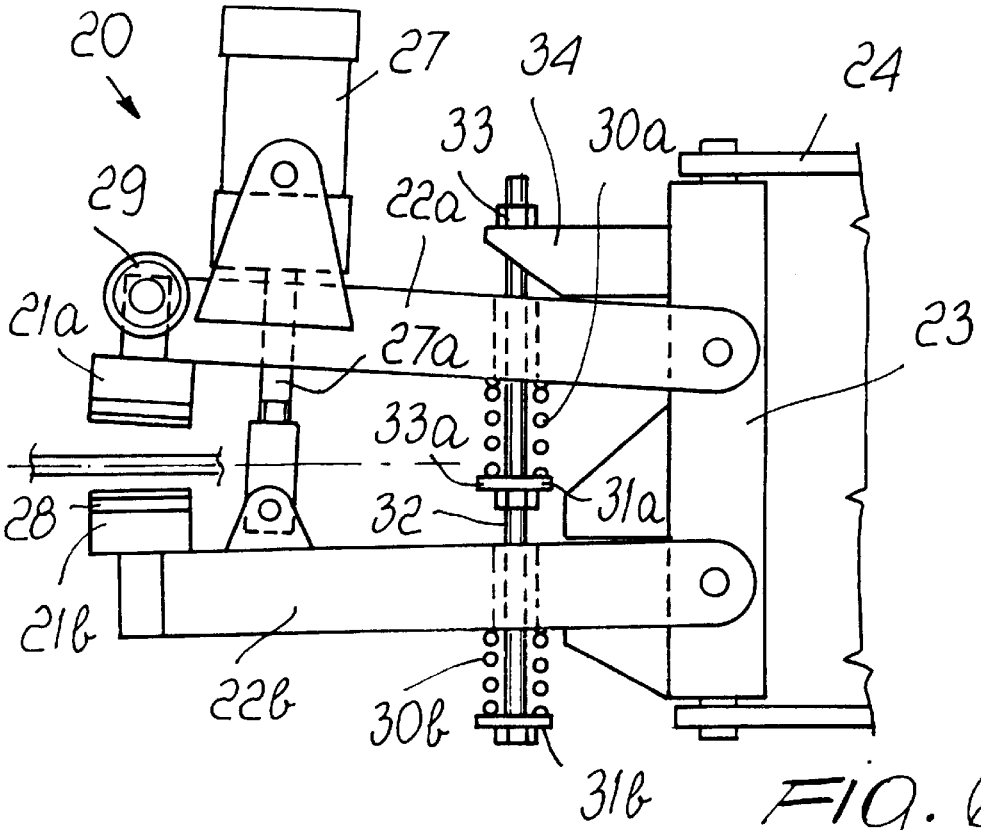
FIGS. 6 and 7 are enlarged-scale side views of a detail of said drawing means during different operating steps.
Figure 7:
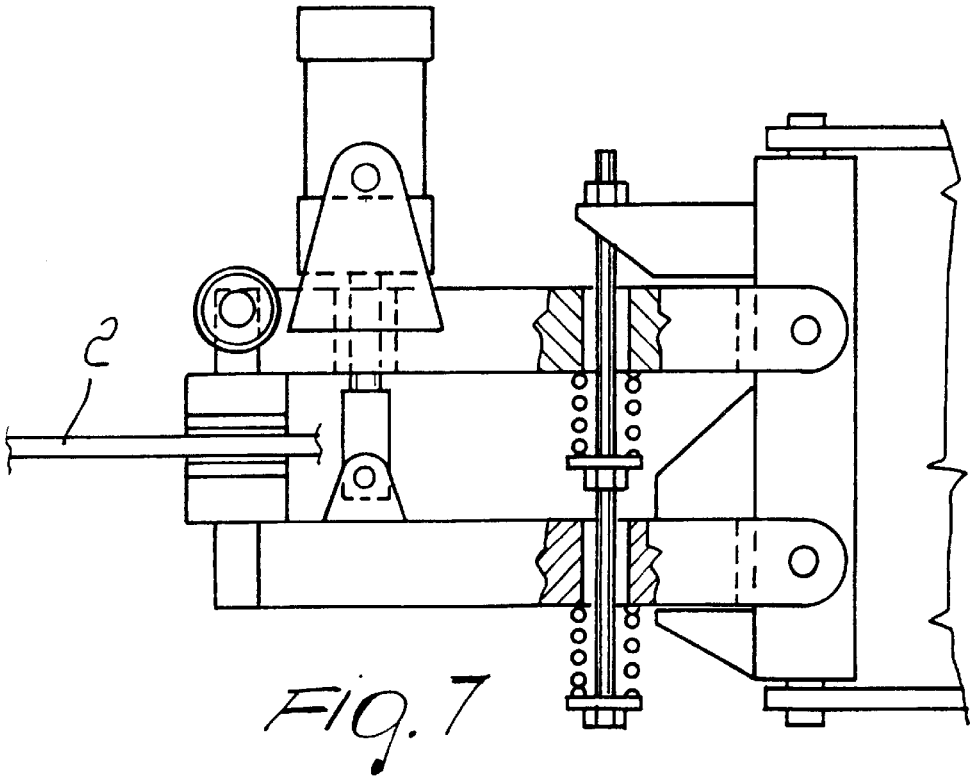
Figure 8:
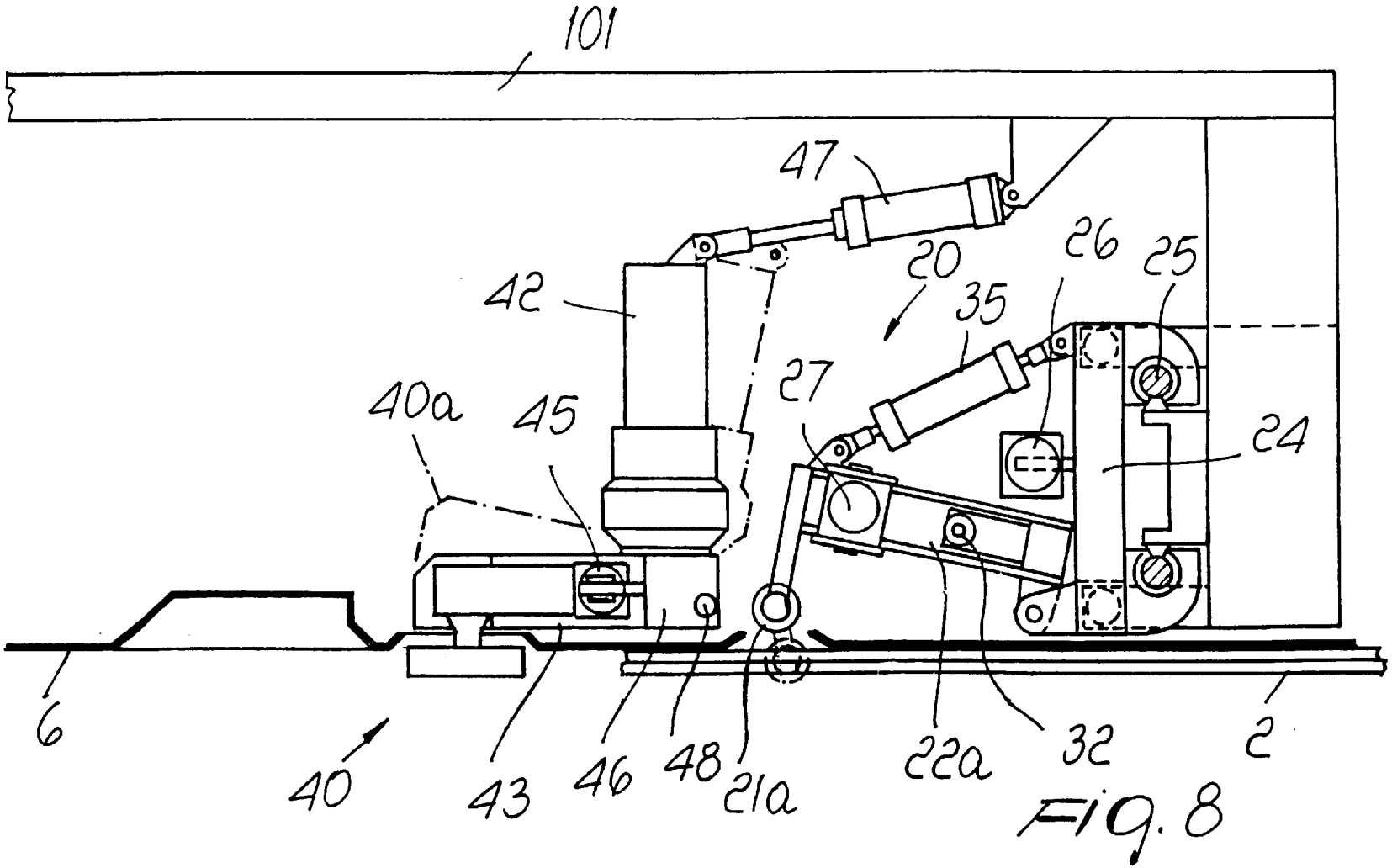
FIG. 8 is a plan view of said drawing and transfer means which operate in the bending machine according to the invention.

More particularly, as shown in FIGS. 6, 7 and 8, the transfer means 20 have, for example, a collet with jaws 21*a*, 21*b* which are supported so as to protrude transversely by corresponding arms 22*a* and 22*b* which oscillate on a same plane and are pivoted, at one end, to a shaft 23 which is supported by a frame 24 so that it can rotate about its own axis. The frame 24 is supported so that it can slide on a pair of posts 25 and can be actuated by an actuator 26 to move the collet 21*a*, 21*b* between said upper and lower positions.

The jaws of the collet 21*a*, 21*b* are actuated in the open and closed positions by an actuator 27 which is supported by the upper arm 22*a* and is articulated, by the stem 27*a*, to the lower arm 22*b*; the jaws 21*a*, 21*b* can be provided with corresponding gaskets 28 made of elastic material which are suitable to prevent slippage and damage of the rods 2 during clamping. The upper arm 22*a* can support, so that it can rotate freely, a roller 29 which is meant to act as a support for the rods 2, as specified hereinafter.

The arms 22*a*, 22*b* of the collet are actuated elastically by respective spring elements 30*a*, 30*b* which act below said arms 22*a*, 22*b* in abutment against corresponding circular plates 31*a* and 31*b*; said circular plates 31*a* and 31*b* are supported by a threaded stem 32 which is coupled at the top, in a position which can be adjusted through screw means 33, to a bracket 34 that protrudes from the frame 24; further screw means 33*a* lock the upper circular plate 31*a* in an adjustable position.

The collet unit 21*a*, 21*b* can rotate angularly, about the axis of the shaft 23, under the actuation of another actuator 35 which is articulated to the frame 24 at one end and acts on a plane which is perpendicular to the plane of oscillation of the arms 22*a*, 22*b* (FIG. 8).

The actuator 35 is suitable to actuate the angular movement of the collet unit 21*a*, 21*b* between a position which is retracted with respect to the worktable 6 and an active position which can vary with respect to said worktable 6 as a function of the position assumed by the transfer means 20 during transfer between the two upper and lower bending positions (FIG. 8).

Between the bending unit 10 and the transfer means 20, at the lower bending position 12, drawing means 40 are provided which are suitable to move the rods 2 longitudinally. Said drawing means 40 are preferably constituted by at least one pair of contrarotating wheels 41*a*, 41*b* which are rotatably supported through another opening 9 formed in the front platform 6. The lower driving wheel 41*b* is rotated by a motor element 42 by means of a suitable transmission element 43; the upper wheel 41*a* is conveniently supported by an arm 44 which can oscillate under the actuation of a corresponding actuator 45 which is articulated to a post 46.

The upper wheel 41*a* may be mounted so that it can rotate on an axis 48 which is longitudinal with respect to the post 46, under the actuation of a further actuator 47 which is articulated to the fixed frame 101 of the machine at one end and to the motor 42 at the opposite end and acts on a plane which is perpendicular to the plane of the wheels 41*a*, 41*b*.

The actuator 47 is suitable to actuate the angular movement of the wheel 41*a* between a disengagement position, which is retracted with respect to the worktable and is illustrated by the dashed line 40*a* in FIG. 8, and an active position, which coincides with said worktable.

The opening 9 of the drawing means 40 is conveniently covered, particularly if the wheels 41*a*, 41*b* have a fixed position, by a housing which is not shown; said housing has flared sides, like the housing 4 of the feeder means, and has a slot for the passage of the rods supported by the collet 21*a*, 21*b*.

At the upper position, along the feed line 3, the bending machine has a guiding channel 16 which is suitable to receive, during an operating step, the portion of the rods 2 that protrudes forward with respect to the transfer means 20. The channel 16 has a bottom 17 which can be opened by means of a lever system 18 actuated by an actuator 19.

The bending machine also has, at said lower position, a plurality of retractable supports 36 suitable to act as a support, during an operating step, for the portion of the rods 2 that protrudes forward with respect to the transfer means 20. The supports 36 protrude, in the active position, from corresponding openings 37 formed in the platform 6.

In a different embodiment, said supports 36 can slide on the worktable 6 of the machine, in corresponding openings illustrated by the dashed line 37*a* in FIG. 1, from a position which substantially corresponds to the rod feed line 3 to a lower position which is suitable for bending the rear end of said rods. Said movement, which is synchronized with the similar movement of the transfer means 20, allows the controlled movement of the rods between said two positions.

Operation of the bending machine is as follows.

The rods 2 to be bent are fed along the line 3 in output from the feeder elements and initially engage, with their front end, the bending unit 10 which is arranged at the first bending position 11 in this step, as shown by the dashed line 10*a* in FIG. 1.

The bending unit 10 produces, in a known manner, the chosen bending of the front end 2*a* of the rods. Of course, the unit 10 can perform, according to requirements, various bendings of the front end 2*a* of the rods, suitably actuating the advancement of said rods with respect to said unit 10.

During this step, the transfer means 20 do not interfere with the worktable.

The further advancement of the rods 2 is then actuated and said rods slide by resting on the optional roller 29 of the transfer means 20 (see FIG. 4) and engage the channel 16 with their bent front end 2*a*. During this step, the collet unit 21*a*, 21*b* is optionally in the position that allows said resting on the roller 29.

Once the intended extension has been reached, i.e., once the linear extension of the finished shaped product has been reached, the rods 2 are gripped between the jaws of the collet 21*a*, 21*b* of the transfer means 20 and then cut by means of the cutting unit 5.

The cut rods 2 are then transferred from said upper position, at the feed line 3, t o said lower position. During said transfer step, the wheels 41*a*, 41*b* of the drawing means 40 are open in order to allow the insertion of the rods 2 between said wheels.

More specifically, the jaws of the collet 21*a*, 21*b* are first retracted inside the machine, under the actuation of the actuator 35, moved at the rods in the open configuration and again rotated into the working position (FIG. 6); the jaws of the collect are then clamped on the rods 2 by actuating the actuator 27.

It should be noted that the action of the springs 30*a*, 30*b* that act on the arms 22*a*, 22*b* allows to provide an elastic clamping of the rods 2 on the part of the jaws of the collet 21*a*, 21*b*. The screws 33, 33*a* also allow to adjust the clamping force of the springs 30*a,* 30*b* as a function of the diametrical dimensions of the rods 2.

The transfer means 20 are moved by actuating the actuator 26, which actuates the sliding of the frame 24, to which the arms 22*a,* 22*b* of the collet unit 21*a,* 21*b* are pivoted, along the posts 25 into the lower bending position, combining said transfer motion with the angular rotation of the collet so as to avoid any interference of the rods with the wheels 41*a,* 41*b* of the drawing means 40 (see FIG. 8).

Once the lower position has been reached, the collet unit 21*a,* 21*b* is rotated in the opposite direction in order to insert the rods 2 between the open drawing wheels 41*a,* 41*b*. The rods 2 are thus clamped between said wheels 41*a,* 41*b* under the actuation of the actuator 45 and simultaneously released by the collet 21*a,* 21*b*. Once the chosen bendings have been performed, in order to facilitate the extraction of the bent rods the collet 21*a,* 21*b,* which is closed in the retracted position, is again rotated outward simultaneously with the retraction of the retractable supports 36.

Figure 5:
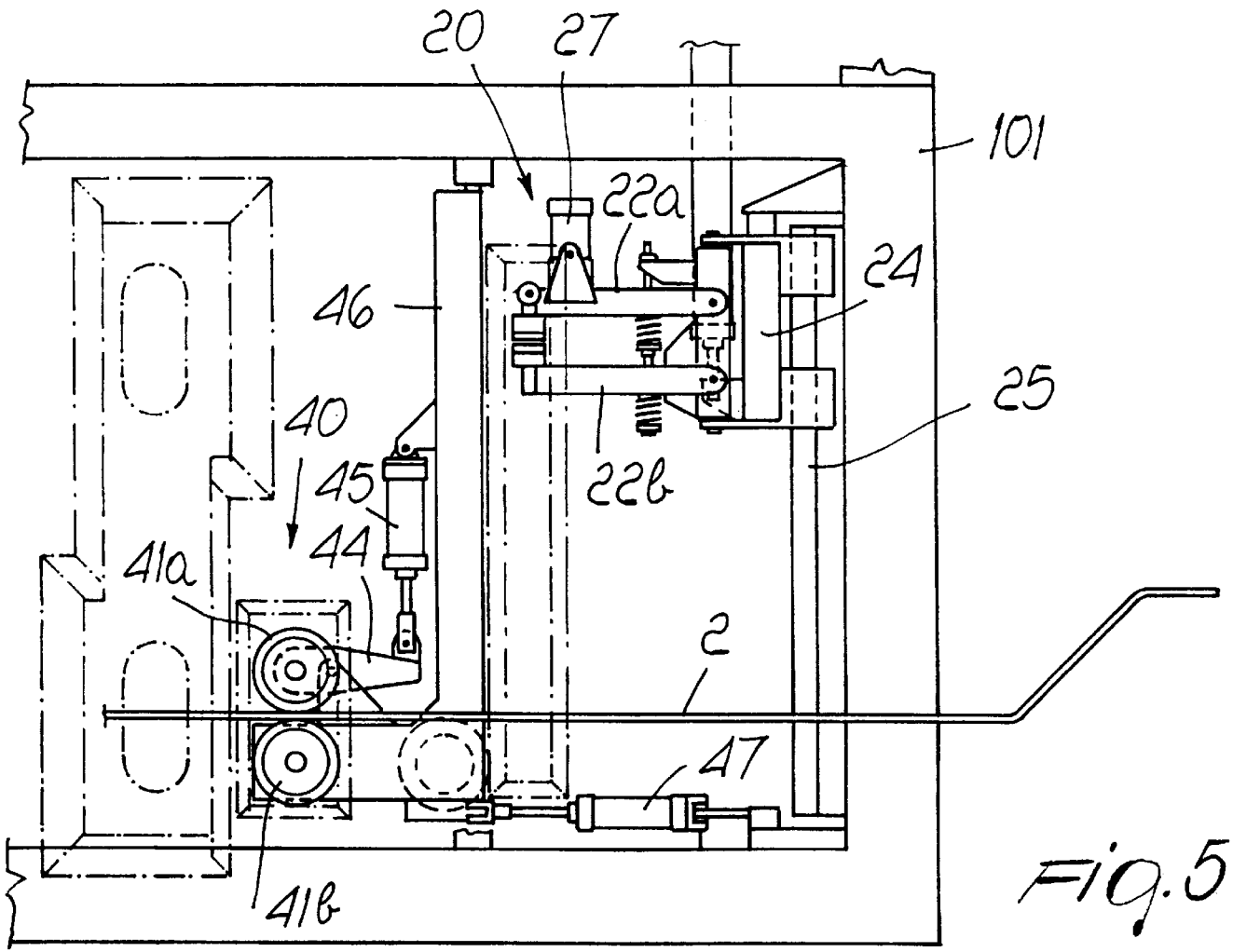
FIG. 5 is an identical side view of the bending machine in a different operating step.

Once unloading has occurred, the collet 21*a,* 21*b* is returned to the upper position in order to prepare for a subsequent transfer of the rods (FIG. 5).

As an alternative, it is possible to transfer the rods 2 at the worktable, moving instead the drawing wheel 41*a* in the retracted position 40a to avoid interference with said rods.

The wheel 41*a* is returned to the active position, in the open configuration, after the rods 2 have been transferred to the lower position.

The movement of the bending unit 10 into the second bending position 12, arranged in the lower position, is actuated simultaneously with the transfer of the rods 2.

The bending unit 10 can therefore provide the intended bending of the rear end 2*b* of the rods. Of course, the unit 10 can perform, according to requirements, various bendings of the rear end of the rods, as shown by the dashed line 2*c* in FIG. 1, appropriately actuating the longitudinal movement of said rods with respect to said unit 10 through the actuation of the drawing means 40.

The drawing means 40 may of course differ constructively from the above description. For example, the drawing means can be constituted by suitable collet-like grip means which can move under the actuation of reciprocating means longitudinally to the rods.

Once bending of the rods has ended, the drawing wheels 41*a,* 41*b* are opened and the wheel 41*a* is moved into the retracted position and, after moving downward until it is tangent to the wheel 41*b,* it protrudes again simultaneously with the retraction of the supports 36 in order to unload said rods.

Figure 2:
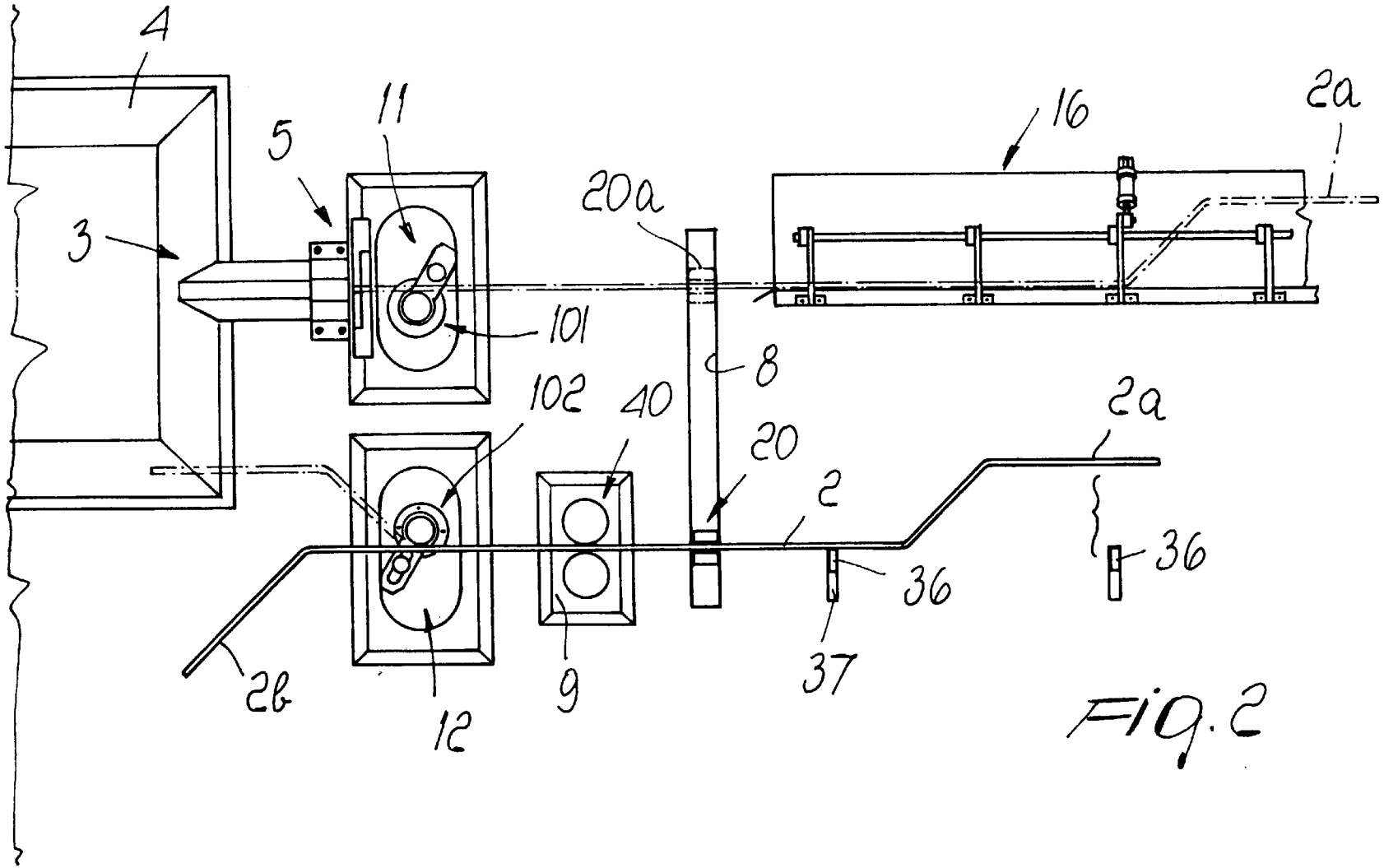
FIG. 2 is a similar schematic side view of a second embodiment of the bending machine according to the invention.

FIG. 2 illustrates a second embodiment of the bending machine, in which said bending means are constituted by a first bending unit 101, arranged in the first upper bending position 11, and a second bending unit 102, which is arranged in the second lower bending position 12.

In this case, as easily understandable, the first bending unit 101 bends the front end 2*a* of the rods that are fed along the line 3 in the upper position. The rods 2 are then cut to size and transferred, as described above, to the lower position, where the second bending unit 102 bends the rear end 2*b* of the rods.

Figure 3:
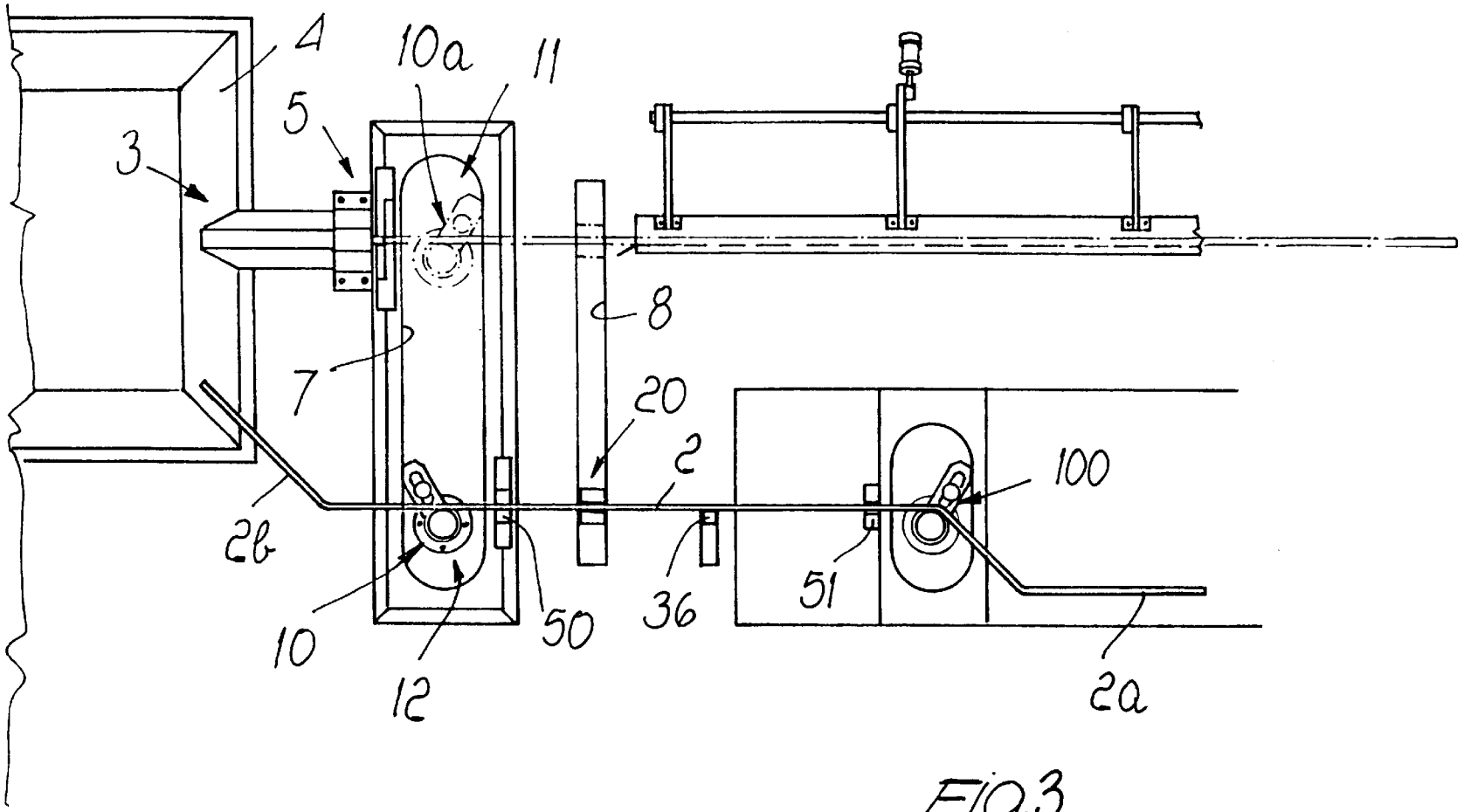
FIG. 3 is a similar side view of a third embodiment of the bending machine according to the invention.

FIG. 3 illustrates a third embodiment of the bending machine, in which said bending means include a bending unit 10, which can move between said upper and lower positions, substantially as described in the case of the first embodiment, and an auxiliary bending unit 100, which is arranged at the same lower position in front of said transfer means 20.

The auxiliary bending unit 100 can move in a direction which is parallel to the feed line 3, i.e., longitudinally to the rods 2 arranged in said lower position, under the actuation of movement means which are not shown.

A first grip element 50 and a second grip element 51 of the collet type are associated with the bending units 10 and 100, respectively, and are suitable to clamp, in a suitable operating step, the rods 2 arranged in the lower position. The first grip element 50 is arranged in a stationary position adjacent to the bending unit 10 which is arranged in said upper bending position 11, while the second bending element 51 is arranged adjacent to the auxiliary bending unit 100 and moved together with it.

According to this embodiment, the bending machine does not have the drawing means 40 because the advancement of the rods is provided by the auxiliary bending unit 100 and by the grip element 51 associated therewith.

In practice, in this case the rods 2 to be bent are fed along the line 3 at the upper position, cut to size by the cutting unit 5, and then transferred to the lower position by the transfer means 20.

In the lower position, the rods 2 are clamped by the grip elements and alternately bent according to known operating methods.

In practice, the bending units 10 and 100 perform bending in alternate steps, respectively at the rear end and at the front end of the rods 2; during said bending steps, the corresponding grip elements 50 and 51 are closed. The auxiliary bending unit 100 can further move in opposite directions so as to be able to slide in a reciprocating manner with respect to the rods 2 or draw said rods.

It should be noted that in this embodiment both ends 2*a,* 2*b* of the rods are bent at the lower position. The bending unit 10, however, can be moved into the upper position 10*a* if the machine is used to produce stirrups and the like.

In a simpler constructive variation of said third embodiment of the machine, the function of the stationary grip element 50 is performed by the collet of the transfer means 20, leaving the working cycle substantially as described.

In conclusion, the illustrated method allows to provide in a simple and functional manner the automatic bending of the opposite ends of rods and the like according to any preset profile.

This is caused in particular by the fact that at least the bending of a rear end of the rods is performed in a bending station which is arranged in a lower position with respect to the line along which said rods are fed.

A particular advantage of this solution is that it avoids downtimes in producing rods bent at their opposite ends, since the step for feeding the rods to be bent occurs at least partially independently and in periods which partially coincide with the execution of said bending of the rear end.

The machine according to the first embodiment, shown in FIG. 1, allows to feed the rod at least up to the length that corresponds to the first front bend simultaneously with the active bending step performed on the previous rod in the rear part by the bending head that is in the lower position.

The second embodiment, shown in FIG. 2, by using two different bending units in the upper position and in the lower position, has an almost complete coverage period between the operating steps performed in said upper and lower positions. The bending of the rear end of the rods, in the lower bending station, occurs substantially simultaneously with the feeding action, with the bending of the front end and with the cutting of successive rods in the upper bending station.

A very extensive coverage period is also achieved in the third embodiment, shown in FIG. 3, in which the bending of the opposite ends of the rods is performed in alternate steps in the lower position, using a stationary bending unit and a movable auxiliary bending unit, while in the upper position the rods to be bent are simultaneously fed and cut to size.

Moreover, all the above solutions share the possibility to alternate the production of shaped rods with the production of straight rods, using for this purpose the time during which the bending cycles are performed. In particular, it is possible to produce the straight rods in the upper position, alternating them with the shaped rods, while said cycles for bending the previously fed shaped rods are performed in the lower position.

The straight rods thus produced may be unloaded together with the shaped rods or by using suitable separate removal means.

Another considerable advantage offered by the bending machine according to the invention is the fact that it is possible to bend the rear end of the rods without problems in terms of bulk or interference with other parts of the machine, particularly the cutting unit 5, differently from what occurs in other currently known machines. Since said rear bending is in fact performed in a station which is lower than the upper position of the feed line 3, along which the cutting unit 5 is arranged, the rods to be bent can move backward freely, remaining on the worktable.

Another advantage of the bending machine according to the invention is its great operating flexibility, since it is possible to provide not only said bent rods but also a wide variety of different products, such as open or closed stirrups, circular or polygonal spirals, and the like. In particular, the machine can work as a conventional stirrup bender, using a single bending unit arranged in the upper bending station along the rod feed line.

Moreover, there is no risk of jamming of the rods in the openings of the operating elements, differently from what occurs in currently known machines.

FIGS. 9, 10, 11 and 12 illustrate another embodiment of the bending machine, provided with a bending unit 10 which moves, at the opening 7 formed in the front platform 6, between a first bending position 11, arranged at the feed line 3, and a second bending position 12, which is preferably arranged in an upper position than said position for feeding the rods 2.

The means 120 for transferring the rods 2 from the lower bending position 11 to the upper bending position 12 work to the side of the bending unit 10 and are constituted for example by said collet, which is actuated at the second opening 8 formed in the front platform 6.

The transfer means 120 can move between a retracted position with respect to the worktable 6 and an active position at said worktable 6; the transfer means 120 can also move between the two lower and upper bending positions.

Figure 9:
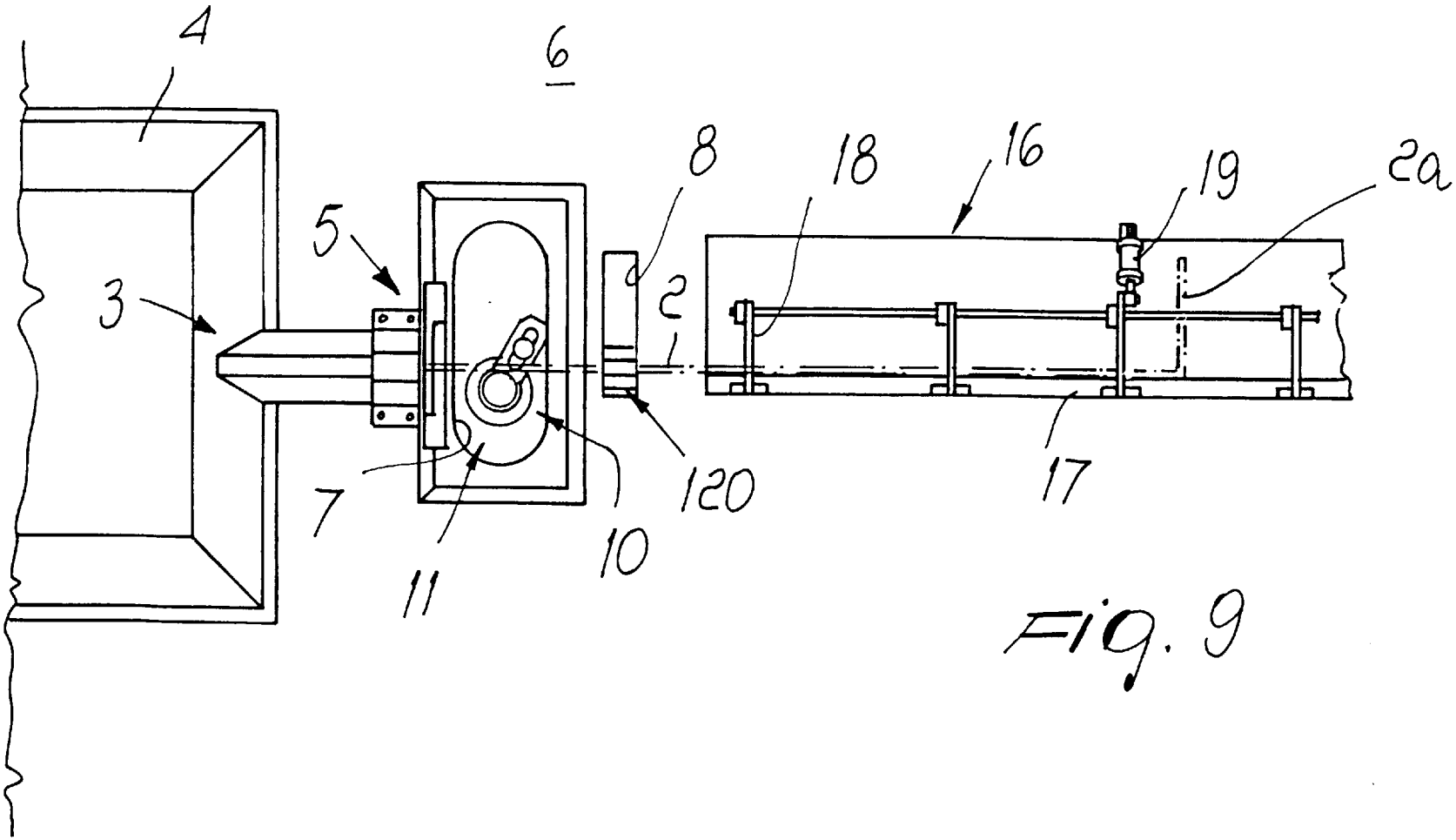
FIGS. 9, 10, 11 and 12 are schematic side views of other embodiments of the bending machine according to the invention during different operating steps.

The bending machine has a guiding channel 16 which is suitable to receive, during an operating step, the portion of the rods 2 that protrudes forward with respect to the transfer means 120 (FIG. 9). The guiding channel 16 has, as mentioned, a bottom 17 which can be opened by means of a lever system 18 actuated by an actuator 19. The guiding channel 16, or just the bottom 17 thereof, can move under the actuation of means which are not shown in order to follow the translatory motion applied to the rods 2 between said lower bending position 11 and said upper bending position 12.

Figure 10:
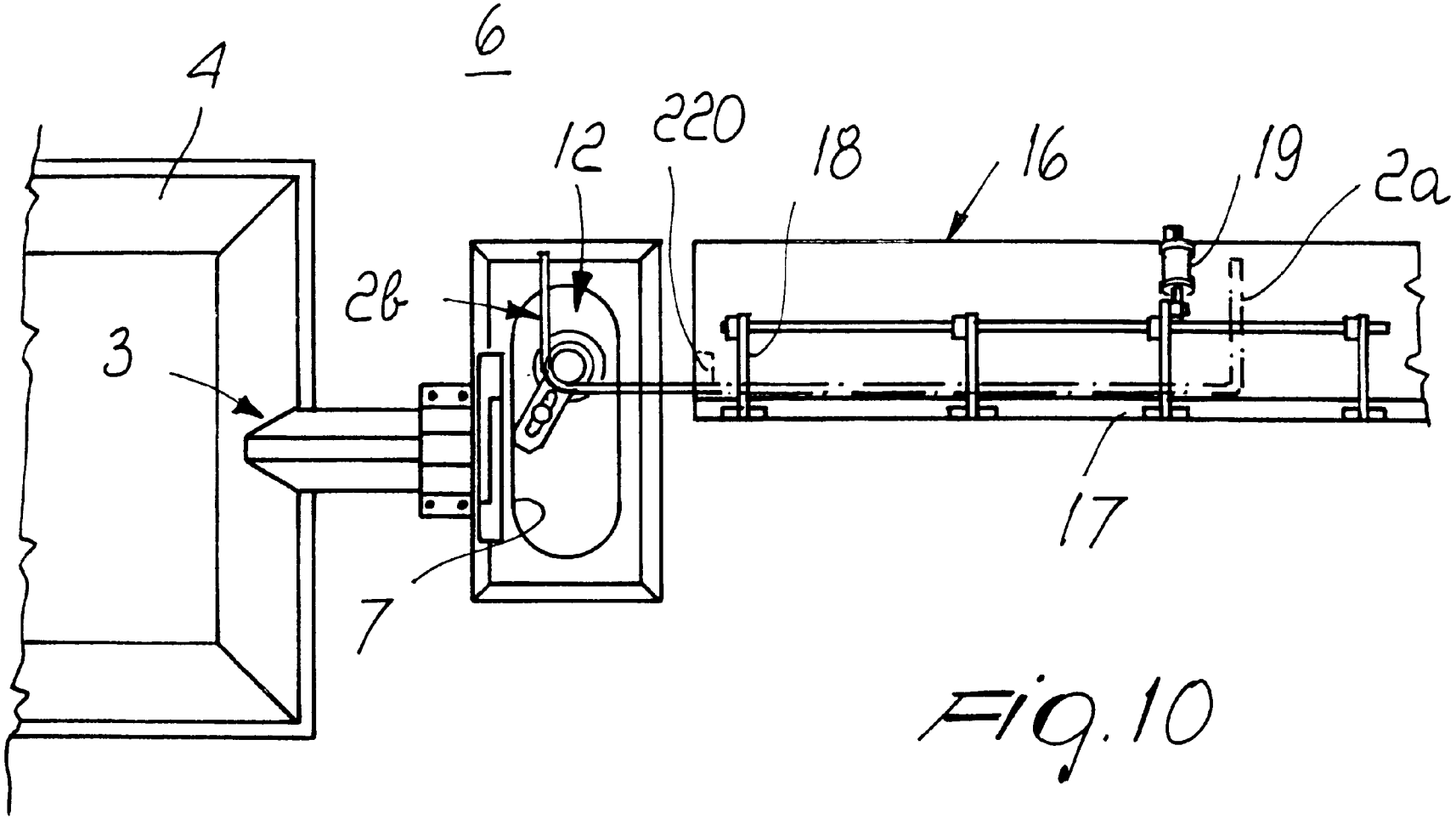

As an alternative to the transfer means 120, it is possible to provide locking means 220 which are supported by the guiding channel 16, preferably in a rear position, and are suitable to clamp the rods 2 during cutting and transfer and to act as an abutment during the bending of said rods (FIG. 10).

Figure 11:
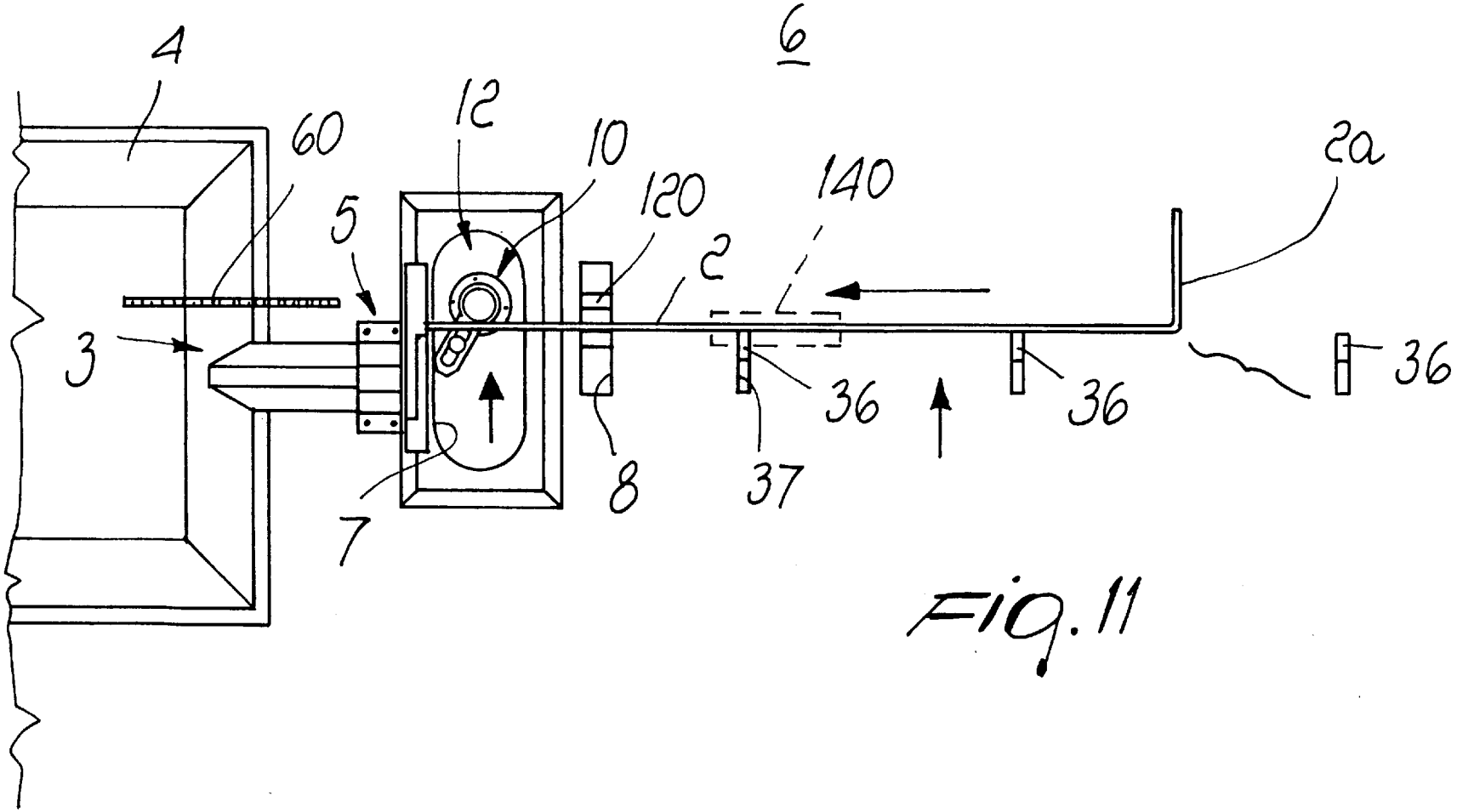
Figure 12:
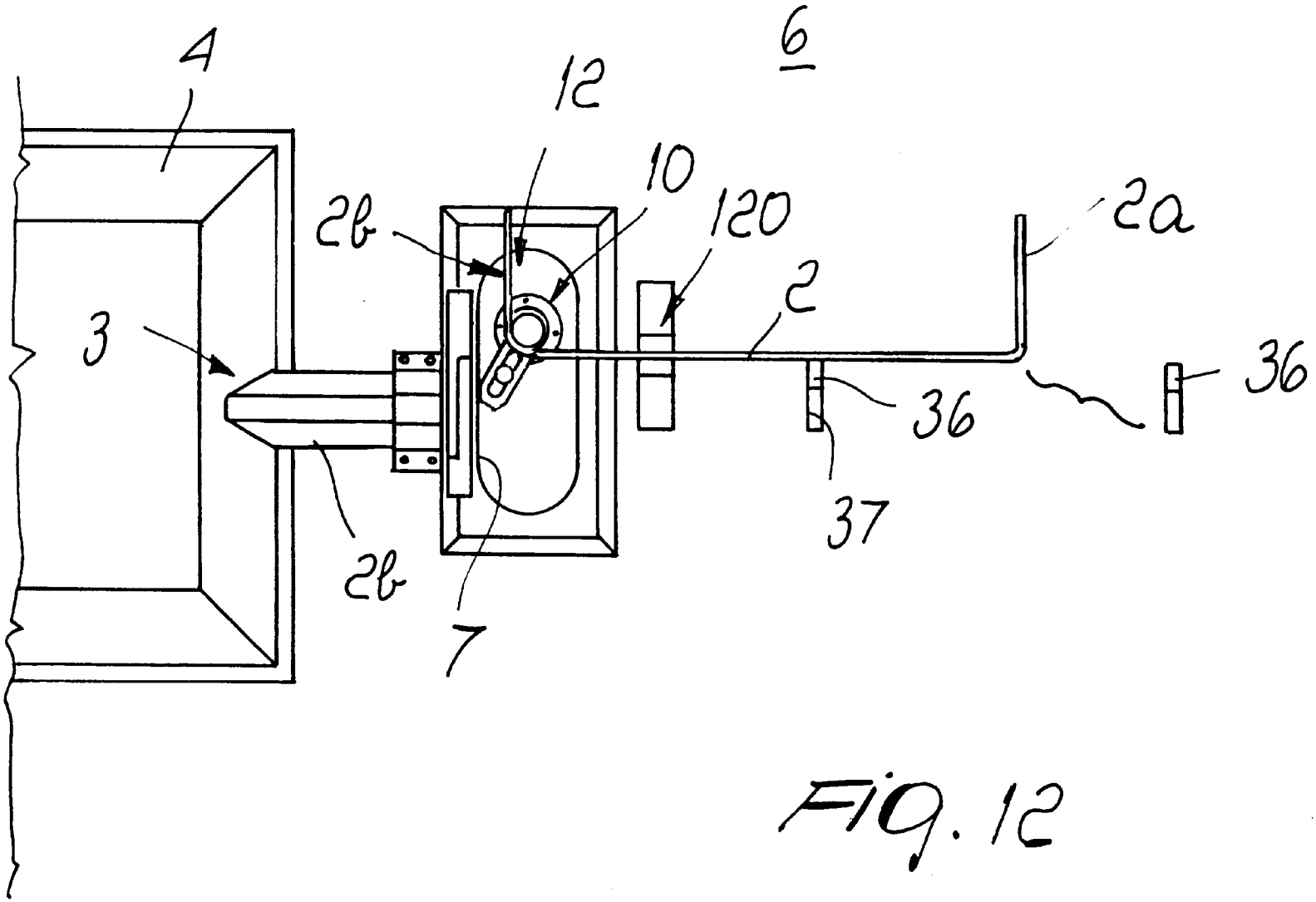

According to another solution, the bending machine may be provided with a plurality of said supports 36 which are retractable and preferably constituted by roller elements which are suitable to act as a support, during an operating step, for the portion of the rods 2 that protrudes forward with respect to the transfer means 120 (FIGS. 11 and 12). The supports 36 protrude, in the active position, from the corresponding openings 37 formed in the platform 6 and can also move between a lower position and an upper position which correspond to said bending positions 11 and 12.

The rods 2 to be bent, fed along the line 3, initially engage with their front end the bending unit 10 which, in this step, is arranged at the first bending position 11 and performs, in the intended manner, the bending of the front end 2*a* of the rods (FIG. 9). During this step, the transfer means 120 are in a position in which they do not interfere with the advancement of the rods.

The further advancement of the rods 2 is then actuated until, once the intended length has been reached, the rods 2 are gripped by the collet of the transfer means 120 or, as an alternative, by the locking means 220 supported by the guiding channel 16 and then cut by means of the cutting unit 5.

The rods 2 are then transferred from said lower position 11, arranged along the feed line 3, to said upper position 12. The rods 2 cut in the upper position are transferred by means of the synchronized movement of the elements that constitute the transfer means 120, in cooperation with the coordinated movements of the guiding channel 16 or of its bottom 17 or of the supports 36; if the transfer means 120 are not present, said transfer is due of course to the movement of the guiding channel 16 or of its bottom, which is provided with the locking means 220 that clamp the rods (FIG. 10).

Simultaneously with the transfer of the rods 2, the bending unit 10 is moved to the second upper bending position 12. At this point the iron rod must be moved longitudinally. In a simpler version, the movement is provided by the manual intervention of the operator, with reference to a graduated rod 60 (FIG. 11) or to another suitable measurement system, such as an abutment, for measurement. Said manual intervention can be performed either directly or through suitable collet-type grip means, schematically designated by the reference numeral 140 in FIG. 11, which can be moved manually longitudinally to the rods.

The bending unit 10 can now produce one or more bends at the rear end 2*b* of the rods (FIG. 12). It should be noted that during the bending step the collet of the transfer means 120 or, alternately, the locking means 220 of the guiding channel 16 keep the rods 2 appropriately clamped and also act as abutment elements.

Figure 14:
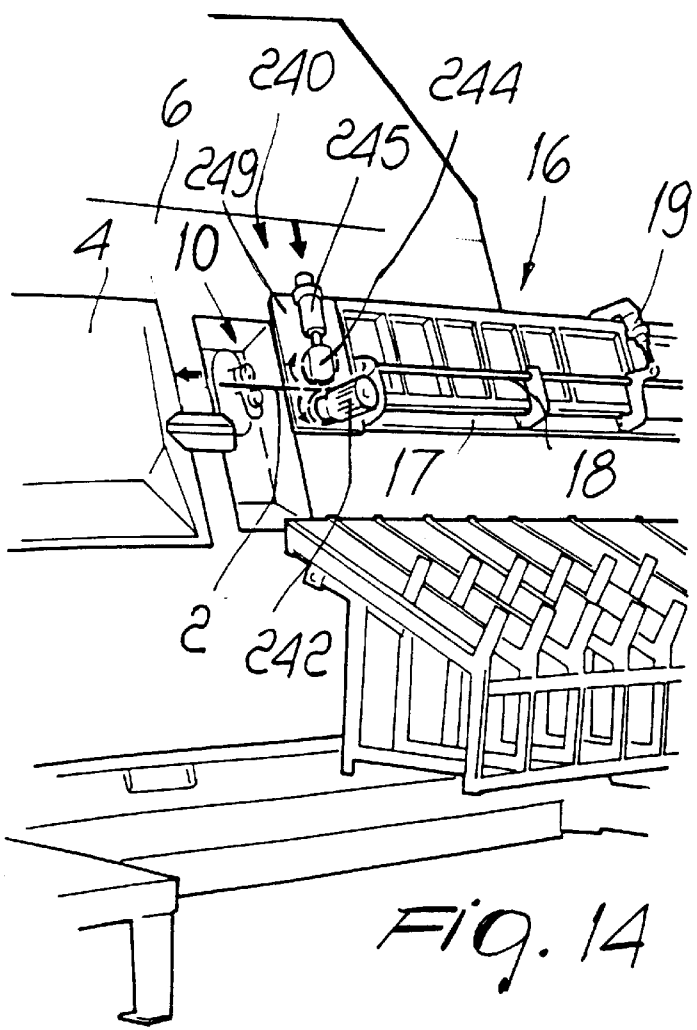
FIGS. 13 and 14 are partial perspective views, during different operating steps, of the bending machine, illustrating specific drawing means.
Figure 13:
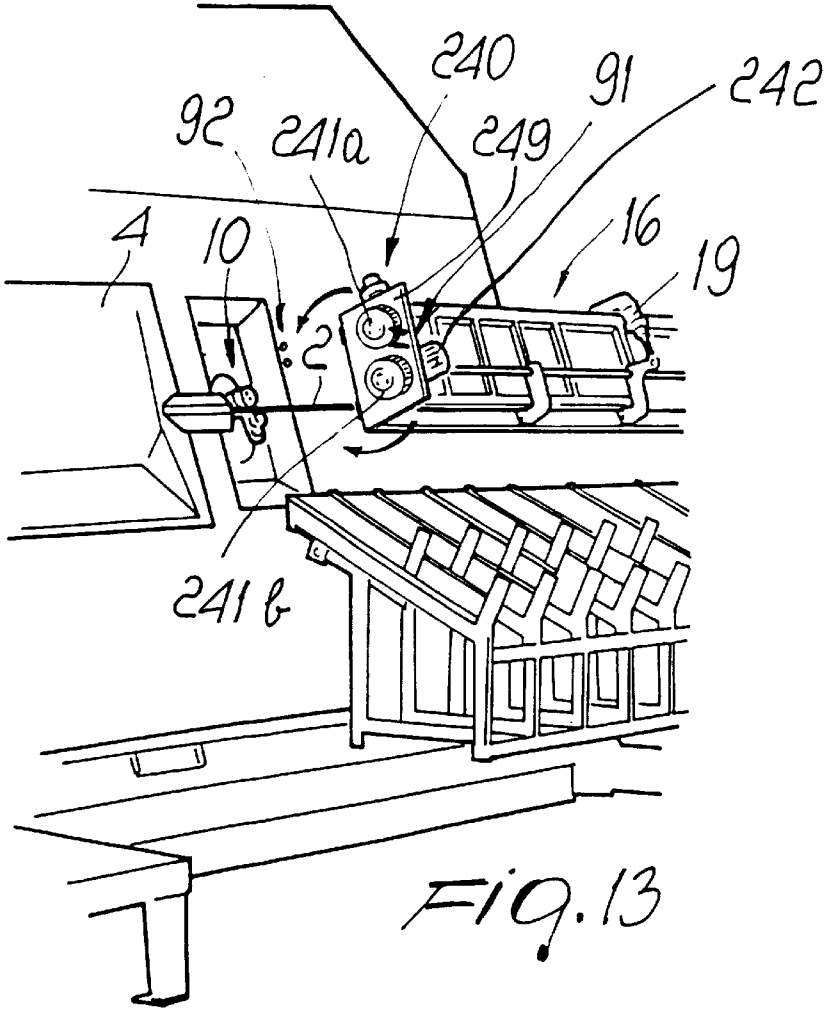

In the embodiment shown in FIGS. 13 and 14 there are provided drawing means 240 constituted by two contrarotating wheels 241*a*, 241*b* which are rotatably supported by a plate 249 pivoted to the guiding channel 16 along one side. The lower driving wheel 241*b* is rotationally actuated by a motor element 242 supported by the plate 249; the upper presser wheel 241a is supported by an arm 244 which can move under the actuation of a corresponding actuator 245 which is likewise supported by the plate 249.

The plate 249 can rotate, either manually or under the actuation of actuators which are not shown, between a raised disengagement position (FIG. 13) and an active position which is adjacent to the platform 6, in which the wheels 241*a* and 241*b* are suitable to clamp the rods 2 to be drawn (FIG. 14).

In a better embodiment, two pivots 91, shown in FIG. 13, are provided on the plate 249 and enter a corresponding pair of holes 92 formed on the worktable of the machine, in order to discharge part of the stresses that act on the plate 249 and are generated during work.

As in the previous solution, the drawing means 240 start to operate after the rods have been transferred to the upper bending position (FIG. 14).

Once the bending of the rods has ended, the drawing wheels 241*a,* 241*b* are actuated so as to open, the rotating plate 249 is turned, the bottom 17 of the guiding channel 16 is opened and said rods are thus unloaded.

Figure 15:
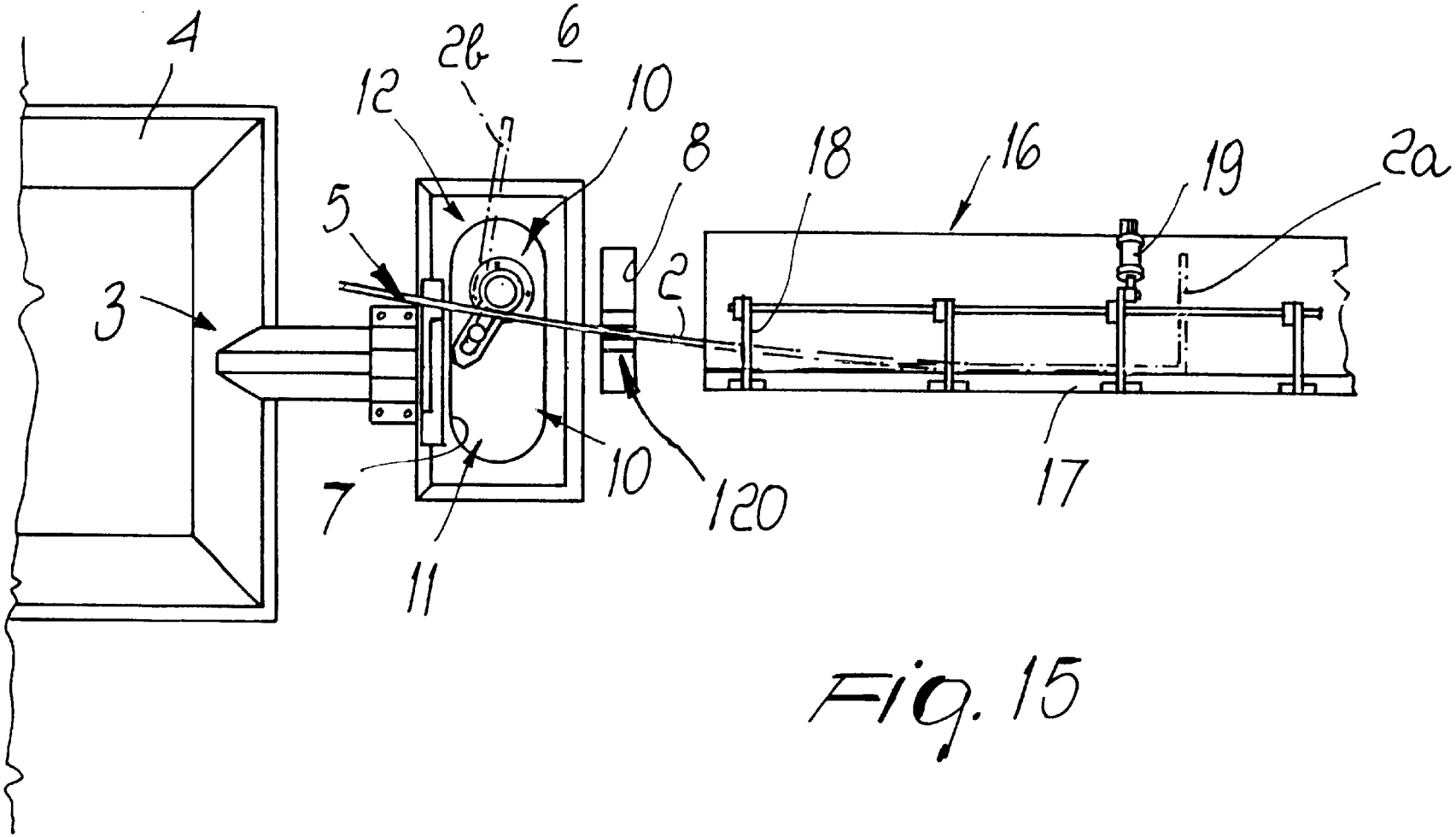
FIG. 15 is a schematic side view of another embodiment of the bending machine according to the invention.

FIG. 15 illustrates another embodiment of the machine which is provided with said transfer means 120 but has a guiding channel 16 which is fixed in a position substantially aligned with the rod feed line 3, at the lower bending position 11.

In this case, after the front end 2*a* of the rods 2 has been bent and said rods have been made to advance until the intended length has been reached, the rods 2 are gripped by the collet of the transfer means 120 and then cut by means of the cutting unit 5.

The transfer means 120 are then moved from the lower position, arranged along the feed line 3, to the upper position, while at the same time the bending unit 10 is moved from said lower bending position 11 to the upper bending position 12.

This produces a limited flexing of the rods 2, which in the front part continue to rest on the bottom 17 of the guiding channel 16, while the rear end 2*b* is bent in the raised rear part, which is gripped by the transfer means 120, which also act as abutment elements.

In the practical embodiment of the invention, the materials employed, as well as the shape and the dimensions, may be any according to requirements.

What is claimed is:

1. A method for automatically bending profiled elements comprising the steps of:

feeding the profiled elements to be bent along a feed line;

transferring said profiled elements from said feed line to a bending station which is arranged in a first bending position with respect to said feed line, said first bending position being in-line with said feed line;

performing at least one bending of at least a first end of the profiled elements in said first bending position;

transversely moving, with respect to said feed line, said profiled elements from said first position to a second position, in said bending station, which is offset with respect to said first position, without rotating said profiled elements, in order to perform at least one bending of a second end of said profiled elements, said second end being bent out of line with respect to said feed line, said moving from the first bending position to the second bending position being performed only when the at least one bending of said first end of the profiled element is terminated, said bending station comprising only two bending means, one for each respective end of said profiled element, each of said bending means being able to perform plural bendings on one of the ends of said profiled element.

2. A method for automatically bending profiled elements comprising the steps of:

feeding the profiled elements to be bent along a feed line;

transferring said profiled elements from said feed line to a first bending station which is arranged in a first position which is offset with respect to said feed line;

performing at least one bending of at least a first end of the profiled elements in said bending position;

longitudinally moving said profiled elements from said first position to a second position which is also offset with respect to said feed line, in order to perform at least one bending of a second end of said profiled elements.

3. A machine for automatically bending profiled elements, comprising:

a feed line for feeding the profiled elements to be bent;

a bending station comprising movable bending means which are suitable to bend at least a first end of said profiled elements, said bending means being movable between a first and a second position with respect to said feed line, said first position being in-line with said feed line and said second position being offset with respect to said first position, said bending station lying on a worktable which contains said line for feeding said profiled elements; said bending means bending a first end of the profiled elements at said first position and a second end thereof at said second position; and means for transferring said profiled elements from said feed line to said bending means arranged in said first or second position.

4. The machine according to claim 3, further comprising drawing means which act at said first or second bending position for the transverse movement of said profiled elements.

5. The machine according to claim 3, wherein said movable bending means comprise a bending unit which moves between a first bending position, arranged at said feed line, for bending the front end of said profiled elements, and a second bending position, and which is arranged in said first or second position with respect to said feed line for said profiled elements, for bending said rear end of said profiled elements.

6. The machine according to claim 5, wherein said bending means further comprise an auxiliary bending unit, which is arranged at said first or second position, in front of said transfer means, and can move longitudinally to said profiled elements arranged in said first or second position in order to bend said rear end of said profiled elements.

7. The machine according to claim 6, wherein a first stationary grip element and a second grip element, which can move together with said auxiliary bending unit, are respectively associated with said bending units, said grip elements being suitable to alternately clamp said profiled elements arranged in said first or second position, during the bending of a front end and of said rear end of said profiled elements, respectively, and to allow the relative motion between said profiled elements and said bending units that is required to perform the intended bending operations.

8. The machine according to claim 4, wherein said drawing means are constituted by collet-type means which can move in a direction which is parallel to said feed line for said profiled elements, longitudinally to said profiled elements arranged in said first position, under the actuation of movement means.

9. The machine according to claim 3, wherein said transfer means have collet-type means that protrude transversely from corresponding arms movably supported by a frame which can move, under the actuation of reciprocating actuation means, between a position at said feed line and said first or second position, at said bending station, said collet-type means being actuatable into the open and closed positions by corresponding actuator means supported by said arms.

10. The machine according to claim 3, comprising, along said feed line, in front of said transfer means, a guiding channel which is suitable to receive, in an operating step, the portion of said profiled elements that protrudes forward with respect to said transfer means, said channel having a bottom which can be opened by means of a lever system which is actuated by actuation elements to unload said profiled elements.

11. The machine according to claim 10, wherein said guiding channel moves between a position in which said channel is substantially aligned with said feed line and the first or second position at said position for bending the rear end of said profiled elements, so as to carry said profiled elements therewith from said position of alignment with said feed line to said first or second position for bending said rear end of said profiled elements.

12. The machine according to claim 3, comprising, in front of said transfer means, a plurality of retractable supporting elements which are aligned with the first bending position and are suitable to act as a support, during an operating step, for a portion of said profiled elements that protrudes forward with respect to said transfer means.

13. The machine according to claim 3, comprising a plurality of retractable supporting elements which move between a position that provides substantial alignment with said feed line and the first or second position at said position for bending the rear end of said profiled elements.

14. The machine according to claim 3, wherein said transfer means can move between a position which is retracted with respect to said worktable and an active position at said worktable and are suitable to move between a position that provides substantial alignment with said feed line and the first or second position at said position for bending the rear end of said profiled elements.

15. The machine according to claim 3, comprising means for locking said profiled elements during cutting.

* * * * *